US008079645B2

(12) United States Patent
LaPointe

(10) Patent No.: US 8,079,645 B2
(45) Date of Patent: Dec. 20, 2011

(54) FORCE MULTIPLIER DEVICE FOR FURNITURE MEMBER ADJUSTMENT

(75) Inventor: Larry P. LaPointe, Temperance, MI (US)

(73) Assignee: La-Z-Boy Incorporated, Monroe, MI (US)

( * ) Notice: Subject to any disclaimer, the term of this patent is extended or adjusted under 35 U.S.C. 154(b) by 965 days.

(21) Appl. No.: 12/040,093

(22) Filed: Feb. 29, 2008

(65) Prior Publication Data

US 2009/0218866 A1 Sep. 3, 2009

(51) Int. Cl.
*A47B 97/00* (2006.01)
*A47C 31/00* (2006.01)

(52) U.S. Cl. ..... 297/463.1; 297/463.2

(58) Field of Classification Search ..... 297/463.1, 297/463.2; 74/505
See application file for complete search history.

(56) References Cited

U.S. PATENT DOCUMENTS 4,828,213 A * 5/1989 Saito et al. ..... 248/421
4,834,333 A * 5/1989 Saito et al. ..... 248/421
5,107,720 A * 4/1992 Hatfield ..... 74/502
5,497,676 A * 3/1996 Barnard ..... 74/501.5 R
7,150,205 B2 * 12/2006 Takachi ..... 74/502.2
7,862,121 B2 * 1/2011 Ishijima et al. ..... 297/367 R

FOREIGN PATENT DOCUMENTS

WO WO 2007086468 A1 * 8/2007

* cited by examiner

*Primary Examiner* — Anthony D Barfield

(74) *Attorney, Agent, or Firm* — Harness, Dickey & Pierce, P.L.C.

(57) ABSTRACT

A furniture member component drive mechanism includes a force multiplying gear assembly. A wire member can slide within a flexible sheath in opposed first and second directions. The wire member is connected to the gear assembly for axial displacement. A lever arm connected to the gear assembly defines a lever arm first axis of rotation. Rotating the lever arm in a first direction about the first axis of rotation axially incrementally displaces the wire member in the first displacement direction. The lever arm is rotatably connected to a pivot base defining a second axis of rotation of the lever arm transverse to the first axis of rotation. Rotating the lever arm about the second axis of rotation displaces the wire member in the second displacement direction.

37 Claims, 11 Drawing Sheets

FORCE MULTIPLIER DEVICE FOR FURNITURE MEMBER ADJUSTMENT

FIELD

The present disclosure relates to devices used to adjust furniture member components.

BACKGROUND

The statements in this section merely provide background information related to the present disclosure and may not constitute prior art.

Conventionally, reclining articles of furniture (i.e., chairs, sofas, loveseats, and the like), referred to hereinafter generally as reclining chairs, utilize a mechanism to bias a leg rest assembly in extended and stowed positions and separate components to allow a back seat member to recline with respect to a seat base. Known furniture members can also include mechanism designs that also permit the reclining chair to rock in a front-to-back motion with respect to an occupant. Occupant lumbar support is commonly provided by one or more cushion members which abut with or are connected to a horizontally configured member such as a strap or similar flexible member. This member is commonly joined at its ends to vertically oriented backrest side support arms which are in turn rotatably connected to a furniture member chair frame.

Most reclining chairs upholster the chair frame and support the chair frame from a stationary base assembly in a manner permitting the chair frame to "rock" freely with respect to the base assembly. In order to provide enhanced comfort and convenience, many rocking chairs also include a "reclinable" seat assembly and/or an "extensible" leg rest assembly. For example, combination platform rocking/reclining chairs, as disclosed in Applicant's U.S. Pat. Nos. 3,096,121 and 4,179,157, permit reclining movement of the seat assembly and actuation of the leg rest assembly independently of the conventional "rocking" action. The leg rest assembly is operably coupled to a drive mechanism to permit the seat occupant to selectively move the leg rest assembly between its normally retracted (i.e., stowed) and elevated (i.e., extended or protracted) positions.

Known leg rest assemblies and furniture member mechanisms are operated by either a manually rotatable handle positioned on an outside surface of the furniture member. When rotated the handle fully repositions the leg rest assembly from a stowed to a fully extended position, or is oppositely rotated to return the leg rest assembly to the stowed position. Known handle operated systems are generally not intended to provide intermediate position control of the leg rest assembly. Other known leg rest assemblies and furniture mechanisms are operated by a release switch which is re-positioned from a normally closed position to a release position, and biased to return to the normally closed position when released by the occupant. These devices are also generally not intended to provide intermediate position control of the leg rest assembly. Lumbar support member and head rest positions, if movable, are generally not controllable by a lever or switch.

SUMMARY

According to several embodiments of the present disclosure, a furniture member component drive mechanism includes a force multiplying gear assembly. A wire member is slidably disposed within a flexible sheath. The wire member is connected to the gear assembly for axial displacement in a first and an opposite second displacement direction within the flexible sheath. A lever arm rotatably connected to the gear assembly defines a lever arm first axis of rotation. Rotation of the lever arm in a first direction about the first axis of rotation operates to axially displace the wire member in the first displacement direction. A pivot base having the lever arm rotatably connected to the pivot base defines a second axis of rotation of the lever arm transverse to the first axis of rotation. The lever arm is rotated about the second axis of rotation to displace the wire member in the second displacement direction.

According to other embodiments, a furniture member component drive mechanism includes a housing. A wire member is slidably disposed within a flexible sheath. The flexible sheath is fixedly connected to the housing. A gear assembly is disposed in the housing, with the wire member connected to the gear assembly for axial displacement in a first displacement direction. A lever arm assembly is rotatably connected to the housing defining a lever arm assembly axis of rotation. The lever arm assembly is connected to the gear assembly such that rotation of the lever arm assembly in a first direction about the lever arm assembly axis of rotation axially displaces the wire member in the first displacement direction.

According to other embodiments, a furniture member component drive mechanism includes a lever arm assembly rotatably connected to the housing defining a lever arm assembly axis of rotation. A gear assembly is disposed in the housing, having a wire member connected to the gear assembly. The gear assembly includes: a sun gear connected to the lever arm assembly, a plurality of planetary gears in meshed relationship with the sun gear, and a gear ring having an internal gear in meshed relationship with the plurality of planetary gears. Rotation of the lever arm assembly in a first direction about the lever arm assembly axis of rotation is operable to axially displace the wire member in a first displacement direction.

According to other embodiments, a furniture member component drive mechanism includes a housing having a bearing sleeve. A lever arm assembly includes: a pivot base having opposed pivot pins oriented facing each other, a lever arm rotatably connected to the pivot pins of the pivot base defining a lever arm/pivot base axis of rotation, and a shaft assembly extending through the pivot base. The shaft assembly is partially received in the bearing sleeve such that the lever arm and the pivot base are together rotatable in a first direction about a lever arm assembly axis of rotation. A biasing element connected to both the housing and the lever arm elastically extends when the lever arm and the pivot base are rotated in the first direction to create a bias force operable when the lever arm is released to return the lever arm and the pivot base in a second direction opposite to the first direction. The lever arm is rotatable about the lever arm/pivot base axis of rotation in a third direction substantially transverse to the first and second directions.

According to still other embodiments, a furniture member, includes a base member and an occupant support component movable with respect to the base member. A drive mechanism mounted to the base member controls displacement of the component with respect to the base member. The drive mechanism includes a housing and a lever arm assembly rotatably connected to the housing, defining a lever arm assembly axis of rotation. The lever arm assembly rotates in each of a first direction and an opposite second direction about the lever arm assembly axis of rotation. A wire member connected to the drive mechanism and the component displaces the component upon actuation of the drive mechanism.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
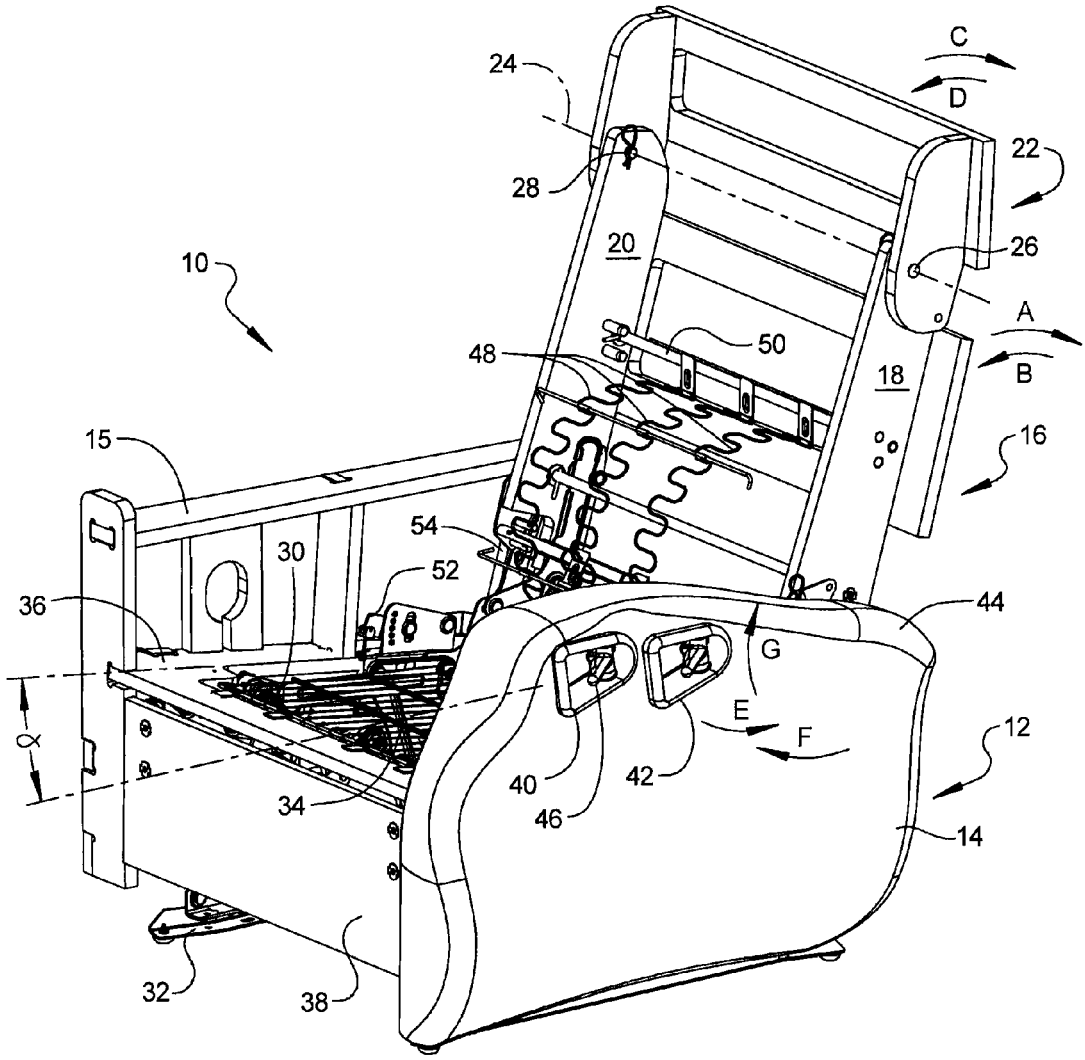
FIG. 1 is a left front perspective view of a furniture member having multiple force multiplier devices of the present disclosure.

The following description is merely exemplary in nature and is not intended to limit the present disclosure, application, or uses. It should be understood that throughout the drawings, corresponding reference numerals indicate like or corresponding parts and features.

Referring to FIG. 1, a furniture member 10 includes a base member 12 having first and second arm rest support members 14, 15. A back support member 16 is rotatably connected for rotation with respect to base member 12. Back support member 16 is rotatably positionable in each of a reclining direction "A" up to a fully reclined position (not shown) and an opposite forward rotation direction "B" to a fully upright position shown. Back support member 16 includes each of a first and a second support wing 18, 20. A head rest assembly 22 is rotatably connected about an axis of rotation 24 to each of the first and second support wings 18, 20 using a first fastener 26 and a second fastener 28. Axis of rotation 24 is defined through the longitudinal axes of first and second fasteners 26, 28.

Furniture member 10 can also include a mechanism 30 which is provided to rotatably connect the back support member 16 to base member 12, and which is also used to connect base member 12 to a stationary support assembly 32. An elastically deflectable occupant support member 34 is connected across an aperture created in a seat pan 36 which forms a portion of base member 12. Mechanism 30 can also rotatably support a leg rest assembly 38 which can extend from a stowed position shown to a fully extended position (not shown).

Furniture member 10 also includes a first force multiplying drive mechanism 40 which can be connected to either first or second arm rest support member 14, 15, and is shown in the exemplary embodiment connected to first arm rest support member 14. A second drive mechanism 42 can also be provided which is mounted rearwardly of first drive mechanism 40 on first arm rest support member 14. Further drive mechanisms (not shown) can also be provided with furniture member 10, connected to either first or second arm rest support member 14, 15, or seat pan 36 in a space partially enclosed by first or second arm rest support member 14 or 15. In the embodiment shown, first and second drive mechanisms 40, 42 are installed in contact with an upholstery layer 44 provided over first arm rest support member 14. In general, further upholstery layers are not shown for furniture member 10 in order to show the details of the actuation system and drive mechanism components of furniture member 10.

First and second drive mechanisms 40, 42 are substantially identical to each other, therefore further reference will be made only to first drive mechanism 40. A lever arm 46 is rotatably provided with drive mechanism 40 such that an occupant of furniture member 10 can reach to an outer facing surface of first arm rest support member 14 to actuate first drive mechanism 40 by rotating lever arm 46 in a ratcheting direction "E". When the occupant releases lever arm 46, lever arm 46 is biased to return in an opposite free return direction "F". Lever arm 46 is also displaceable in a release direction "G" which releases engagement of drive mechanism 40.

Each of the first and second drive mechanisms 40, 42 can be used to operate or adjust independently movable members of furniture member 10. For example, second drive mechanism 42 can be connected to operate a plurality of elastically deformable lumbar supports 48 which are fixedly connected to a rotatable pivot tube 50. Pivot tube 50 is rotatably disposed with respect to each of first and second support wings 18, 20. Actuation of the lever arm 46 of second drive mechanism 42 incrementally changes a position of the elastically deformable lumbar supports 48 to adjust a degree of lumbar support to an occupant desired comfort level. Similarly, first drive mechanism 40 can be connected to a lever member 52. Rotation of lever arm 46 displaces lever member 52. Lever member 52 in turn can be rotatably connected to an actuation link 54 which is operable to rotate head rest assembly 22 about axis of direction 24. Head rest assembly 22 can be rotated in each of a head rest reclining direction "C" and a head rest forward rotation direction "D".

Further details of the operation of first and second drive mechanisms 40, 42 to control the degree of lumbar support discussed above and/or to control the rotation of lever member 52 are provided in greater detail in reference to United States Patent Applications currently filed herewith. These include United States Patent Application entitled "Furniture Member Lumbar Support System" commonly assigned to the owner of the present application, and assigned application Ser. No. 12/040,021, and United States Patent Application entitled "Furniture Member Head Support System" also commonly owned by the assignee of the present application and assigned application Ser. No. 12/040,054, both of which were concurrently filed with the present application, the subject matter of which are both incorporated herein by reference.

Seat pan 36 is oriented at an angle with respect to a floor surface upon which furniture member 10 is positioned. Each of the first and second drive mechanisms 40, 42 and any subsequently used drive mechanism are commonly oriented at a declination angle $\alpha$ with respect to seat pan 36. Declination angle $\alpha$ is selected to provide an angle complimentary with an angle of the arm of an occupant of furniture member 10 to maximize the mechanical advantage to rotate the lever arm(s) 46 by the occupant in any of the seating positions of furniture member 10. According to several embodiments, declination angle α can range from approximately 5° to approximately 25°, however, declination angle α can be greater or less than this range at the discretion of the manufacturer based on the geometry and type of furniture member 10.

Figure 2:
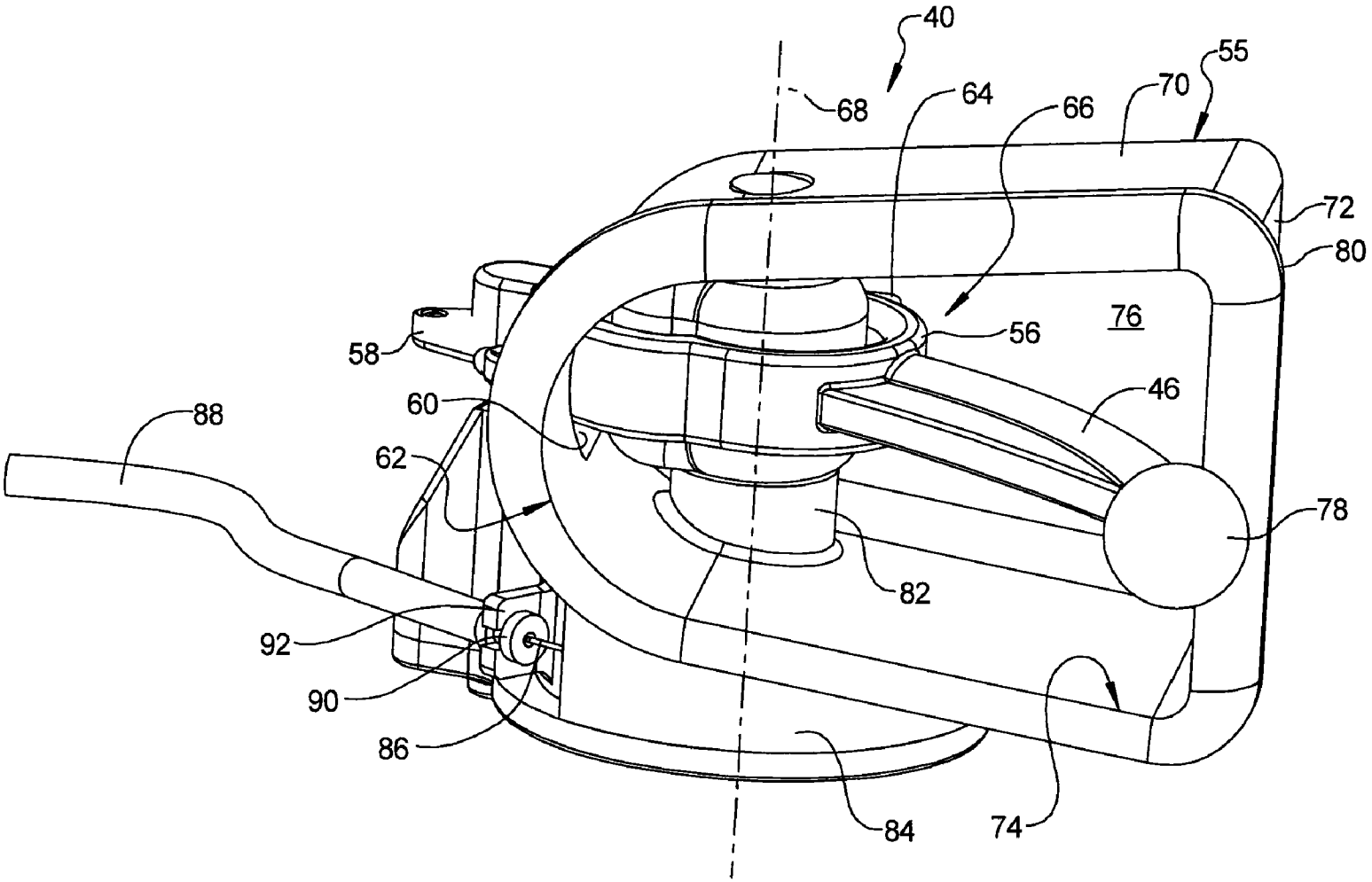
FIG. 2 is a front elevational perspective view of a force multiplier device of the present disclosure.

Referring to FIG. 2, first drive mechanism 40 is shown in greater detail. Again, as previously noted, second drive mechanism 42 and any other drive mechanisms used in furniture member 10 are identical to first drive mechanism 40, therefore further discussion of these drive mechanisms is not included herein. First drive mechanism 40 includes a housing 55 which can be made from a polymeric material that can be molded in the shape shown. A lever mount housing 56 which is homogenously connected to lever arm 46 is rotatably positionable within housing 55 such that a lever contact arm 58 extends outwardly from housing 55 through each of a first aperture portion 60 of a curved first wall 62 of housing 55, and a second aperture portion 64 created in a rear wall 66 of housing 55. First and second aperture portions 60, 64 allow rotation of lever arm 46 and lever mount housing 56 about a lever axis of rotation 68. Housing 55 further includes a housing upper wall 70, a housing end wall 72 which is positioned opposite to curved first wall 62, and a housing lower wall 74. The curved first wall 62, rear wall 66, housing upper wall 70, housing end wall 72, and housing lower wall 74 together define a housing cavity 76 within which lever arm 46 and lever mount housing 56 are rotatably disposed such that only a portion of lever arm 46 extends outwardly from housing 55.

An additional manual grip feature such as a knob 78 can be connected or homogenously extended from lever arm 46. According to several embodiments, lever arm 46, lever mount housing 56, a lever contact arm 58 extending from lever mount housing 56, and knob 78 are all homogeneously joined in a single molded polymeric lever arm component and are collectively referred to as the lever arm. A face plate 80 which extends substantially transverse to curved first wall 62, housing upper wall 70, housing end wall 72, and housing lower wall 74 is provided to aesthetically cover an opening in the upholstery layer 44 shown and described in reference to FIG. 1. Face plate 80 according to several embodiments is also homogeneously connected to the remaining portions of housing 55 and co-molded therewith.

A bearing sleeve 82 is homogenously provided with housing 55 extending from both curved first wall 62 and housing lower wall 74. Bearing sleeve 82 provides rotatable support for the assembly of lever arm 46 and lever mount housing 56. A gear housing 84 is also homogenously connected and co-molded with housing 55.

Rotation of lever arm 46 acts to axially displace a wire member 86 which is slidably disposed within a flexible sheath 88. A stop 90 connected to a first end of flexible sheath 88 is fixed by a stop engagement bracket 92 extending from gear housing 84. Stop 90 ensures that flexible sheath 88 does not longitudinally displace when wire member 86 slidably moves in response to rotation of lever arm 46.

Figure 3:
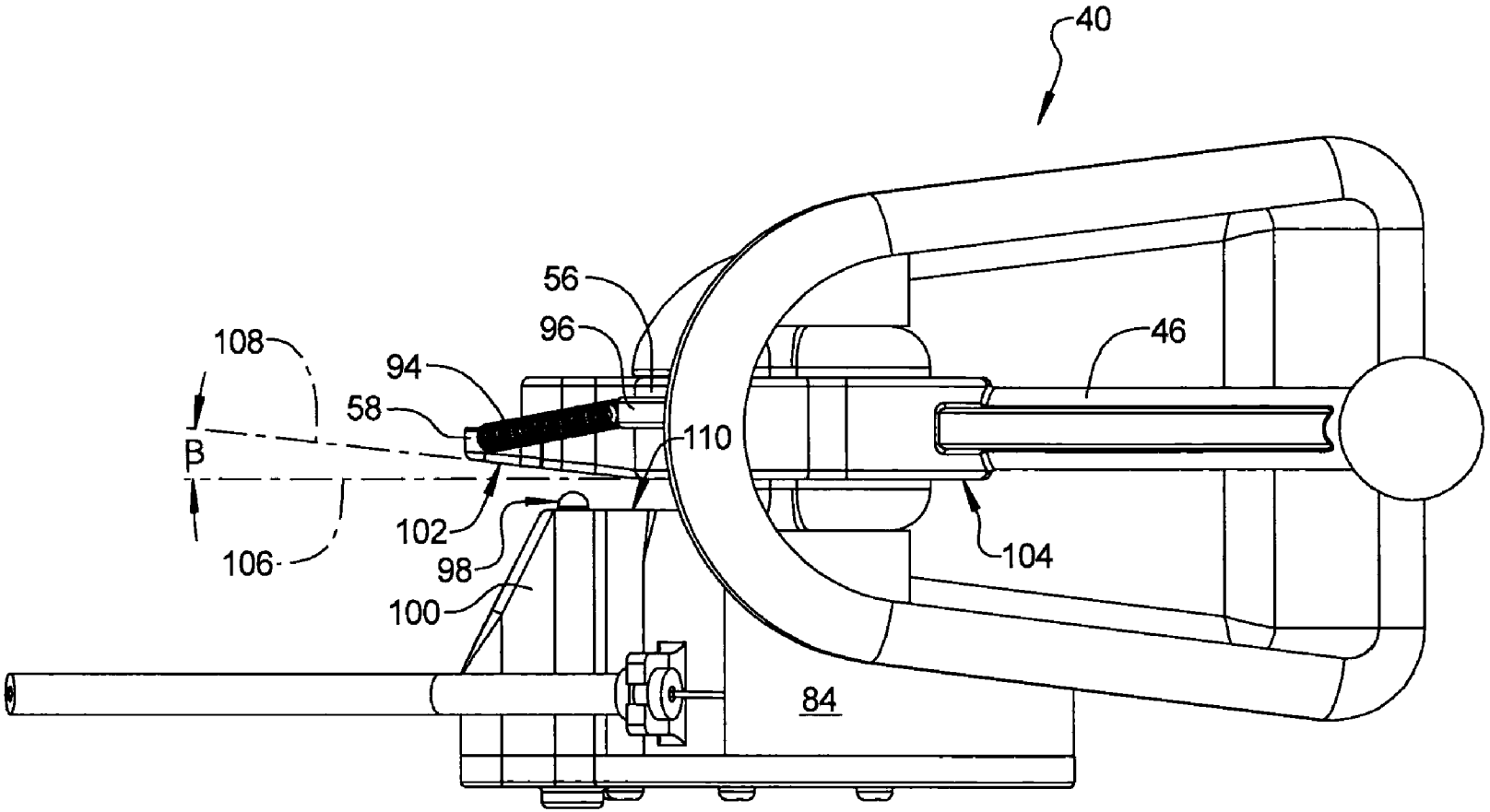
FIG. 3 is a front elevational view of the force multiplier device of FIG. 2.

Referring to FIG. 3, a first biasing member 94 is connected at a first end to lever contact arm 58 and at a second end to a connecting arm 96 extending from lever mount housing 56. According to several embodiments first biasing member 94 can be a coiled tension spring made of a spring steel material. Rotation of lever arm 46 extends first biasing member 94 and therefore creates a biasing force such that when the occupant releases lever arm 46, the biasing force of first biasing member 94 returns lever arm 46 to the position shown. A release switch 98 is biased to the position shown in FIG. 3 and is supported within a tubular portion 100 of gear housing 84. A contact surface 102 of lever mount housing 56 defines a surface alignment angle β which is measurable between a flat surface 104 which defines a first plane 106 and contact surface 102 which defines a second plane 108. Surface alignment angle β is provided to allow lever arm 46 to be rotated upwardly as viewed in FIG. 3 until contact surface 102 contacts a rotation stop surface 110 of gear housing 84, which simultaneously depresses release switch 98 which is further shown and described in reference to FIG. 4.

Figure 4:
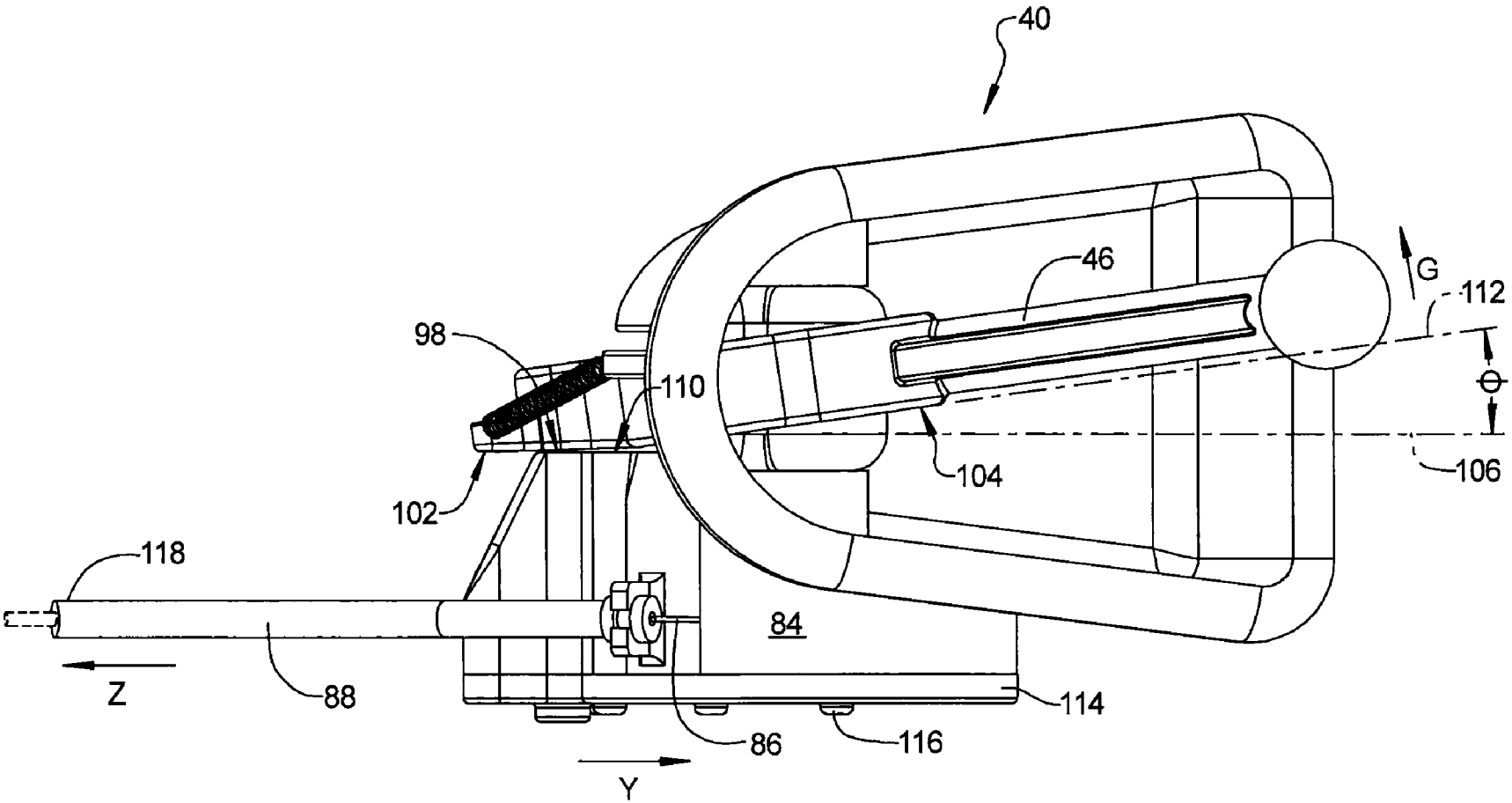
FIG. 4 is a front elevational view of the force multiplier device of FIG. 2 shown in a release operating position.

Referring to FIG. 4, after lever arm 46 has been rotated at least once and potentially multiple times to incrementally displace wire member 86, the tension on wire member 86 can be released by moving lever arm 46 in a release direction "G". Lever arm 46 can be rotated in release direction "G" within a release lift angle θ which is defined between first plane 106 and a release plane 112 co-planar with flat surface 104. As lever arm 46 is rotated in release direction "G", contact surface 102 is brought into contact with rotation stop surface 110 which downwardly depresses release switch 98 thereby releasing the ratcheting force of drive mechanism 40. This permits axial displacement of wire member 86 back to its original position.

Access into gear housing 84 is provided by removal of a gear housing cover 114 which is fastenably engaged to gear housing 84 using a plurality of fasteners 116. Axial displacement of wire member 86 within flexible sheath 88 occurs by rotation of lever arm 46. As previously noted, flexible sheath 88 is fixed with respect to gear housing 84, therefore wire member 86 axially translates within flexible sheath 88 to displace a portion of wire member 86 from a second end 118 of flexible sheath 88.

Referring to FIG. 5 and again to FIG. 4, with gear housing cover 114 removed, the internal components of gear housing 84 are accessible. Wire member 86 is slidably disposed through an apertured block 120 which is fixed with respect to gear housing 84. Wire member 86 is fixedly connected to a slide member 122 using a fixing member 124. Slide member 122 is correspondingly shaped to slide within a semi-circular shaped cavity 126 which is created between an outer wall 128 of gear housing 84 and a gear ring 130. Rotation of lever arm 46 in ratcheting direction "E" displaces slide member 122 about an arc of rotation "H" within semi-circular cavity 126. Each complete rotation of lever arm 46 in ratcheting direction "E" within the constraints of housing 55 incrementally displaces slide member 122 within semi-circular cavity 126. Therefore, multiple rotations of lever arm 46 are required to displace slide member 122 a length of semi-circular cavity 126.

Figure 5:
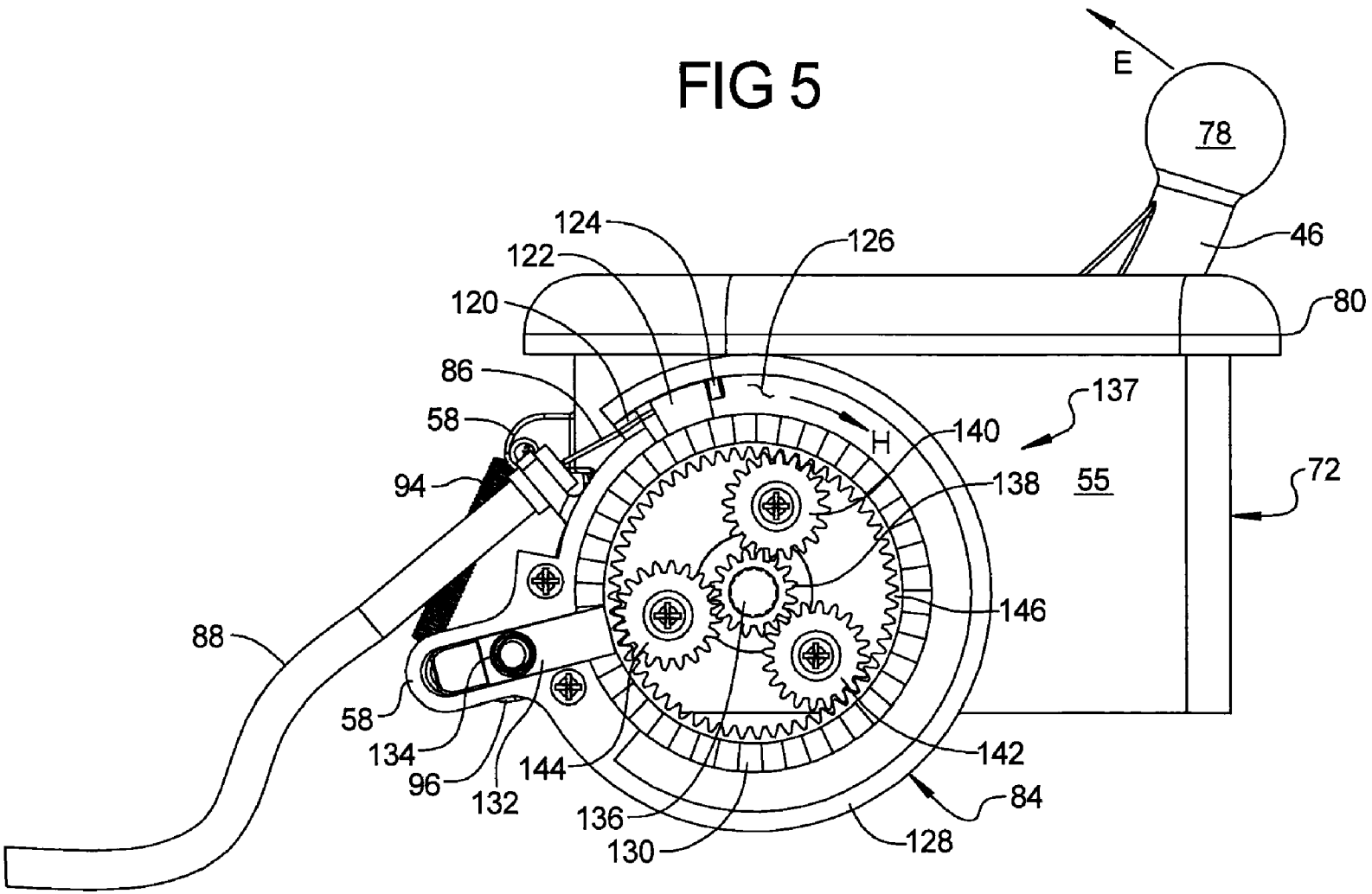
FIG. 5 is a bottom plan view of the force multiplier device of FIG. 2 in an initial neutral operating position.

A total axial displacement of wire member 86 is therefore determined by the arc length defined by semi-circular cavity 126. Rotation of gear ring 130 is provided as a ratcheting circular motion by engagement between gear ring 130 and a ratchet tooth assembly 132. Ratchet tooth assembly 132 is in turn deflectable toward and away from the viewer as shown in FIG. 5 using a second biasing member 134. Second biasing member 134 according to several embodiments can be a coiled compression spring made from a spring steel material. Ratchet tooth assembly 132 and second biasing member 134 are substantially disposed within lever contact arm 58 of gear housing 84.

Gear ring 130 is rotated by rotation of a splined shank 136 which is fixedly received within a sun gear 138. Rotation of lever arm 46 in the first or ratcheting direction "E" co-rotates splined shank 136 and a gear assembly 137. Gear assembly 137 includes gear ring 130 and a sun gear 138 coupled to splined shank 136 to rotate sun gear in the ratcheting direction "E". The teeth of sun gear 138 are meshed with teeth of a first, second and third planetary gear 140, 142, 144 also included in gear assembly 137. Teeth of each of the first, second and third planetary gears 140, 142, 144 are each in turn meshed with an internal gear 146 of gear ring 130. Rotation of lever arm 46 in the ratcheting direction "E" is therefore operable through rotation of each of the first, second and third planetary gears 140, 142, 144 to rotate gear ring 130 in a clockwise direction as viewed in FIG. 5 opposite to the ratcheting direction "E" of lever arm 46. This clockwise rotation of gear ring 130 also displaces slide member 122 within semi-circular cavity 126 in the clockwise direction. A portion of connecting arm 96 is visible in FIG. 5 which is positioned below or away from the viewer as seen in FIG. 5 with respect to lever contact arm 58. As previously noted, connecting arm 96 provides a mounting point for one of the ends of first biasing member 94.

Referring to both FIGS. 3 and 5, drive mechanisms including drive mechanism 40 can fit within a space envelope having a height of approximately 4 in (10.16 cm) corresponding to the device from top-to-bottom as viewed in FIG. 3, a width of approximately 5.5 in (13.97 cm) corresponding to the device from left to right (except for the flexible sheath) as viewed in FIG. 3, and a depth of approximately 4 in (10.16 cm) corresponding to the device from top-to-bottom as viewed in FIG. 5. According to several embodiments, a ratio of an output force of the gear assembly 137 acting on the wire member 86 compared to an input force acting on the lever arm 46 has a range of approximately (2.5 to 4.0) to 1. Also according to several embodiments, a ratio of a radial displacement of the lever arm 46 (about arc or ratcheting direction "E") for a single or one-way rotation of lever arm 46 compared to a radial displacement of the slide member 122 (defined about direction or arc of rotation "H") from a single rotation of lever arm 46, defining an axial output displacement of the wire member 86 has a range of approximately (2.5 to 4.0) to 1.

Figure 6:
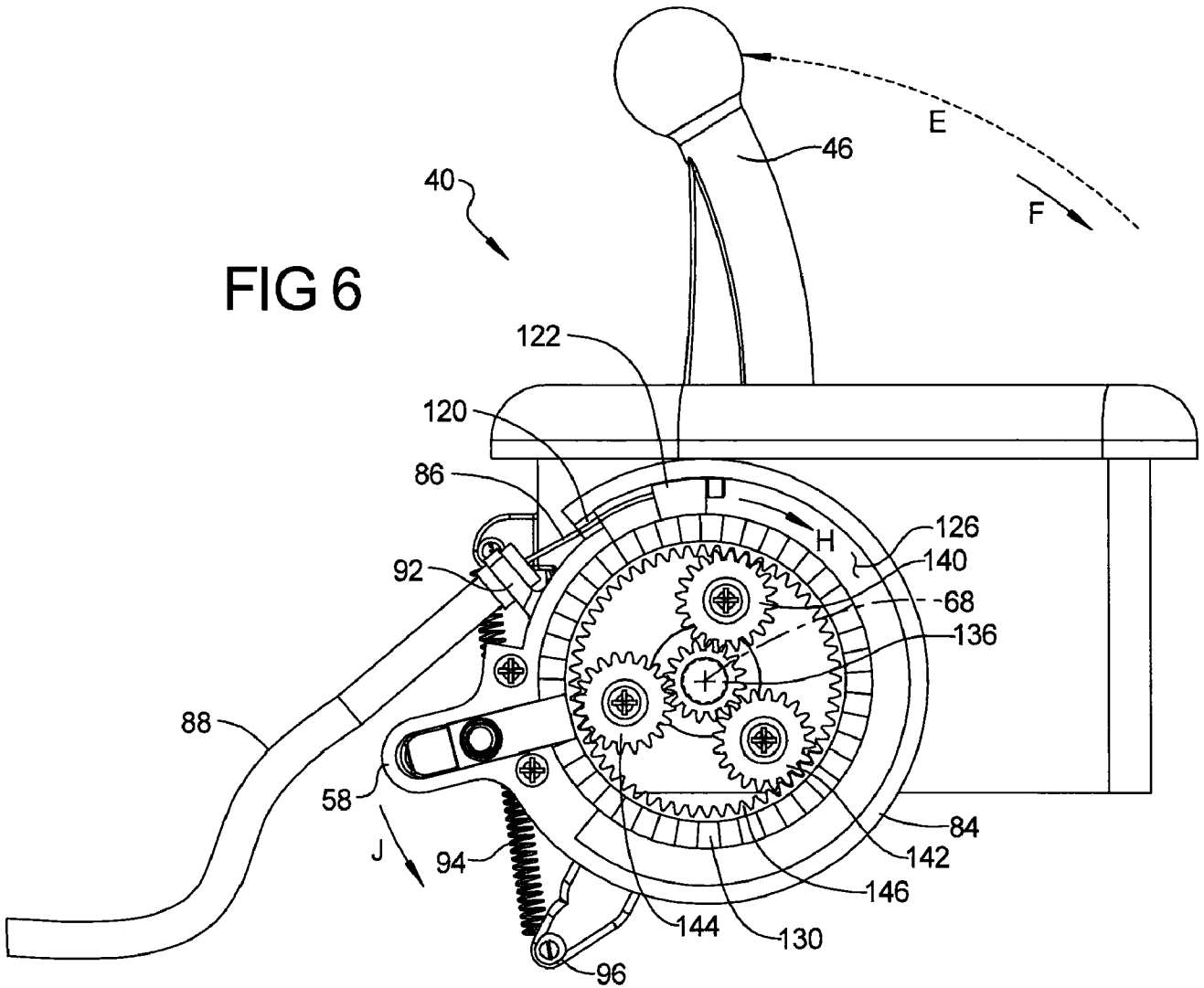
FIG. 6 is the bottom plan view of the force multiplier device of FIG. 5 further showing the device in a first ratcheted displacement.

Referring to FIG. 6, lever arm 46 is shown at a farthest extent of rotation in the ratcheting direction "E". After a single rotation of lever arm 46 to the extent shown in FIG. 6, slide member 122 moves from the position shown previously in reference to FIG. 5 to an incrementally rotated position shown in FIG. 6. Because connecting arm 96 is homogenously connected to lever arm 46, rotation of lever arm 46 in the ratcheting direction "E" also rotates connecting arm 96 in a counterclockwise direction "J". First biasing member 94 is fully extended as shown when lever arm 46 has reached the farthest extent of travel. When the operator releases lever arm 46, the biasing force of first biasing member 94 will return lever arm 46 in the free return direction "F" to the position shown in reference to FIG. 5. Second and subsequent rotations of lever arm 46 can then be performed to continue incremental movement of slide member 122 in the arc of rotation "H" until the component which wire member 86 is connected to is displaced to the desired position of the occupant.

Wire member 86 continues to be axially translated with respect to flexible sheath 88 as slide member 122 is displaced. Rotation of lever arm 46 and subsequent rotation of each of the splined shank 136, the sun gear 138, and the first, second and third planetary gears 140, 142, 144 continue to rotate internal gear 146 and gear ring 130 in an incremental motion providing a force multiplier for the input force provided by the operator or occupant to lever arm 46. Apertured block 120 is provided of a friction reducing material such as a low friction metal or a low friction polymeric material to reduce the drag force on wire member 86 as slide member 122 displaces. Rotation of lever arm 46, splined shank 136, sun gear 138, the first, second and third planetary gears 140, 142, 144, and internal gear 146 of gear ring 130 are all with respect to lever axis of rotation 68.

Figure 7:
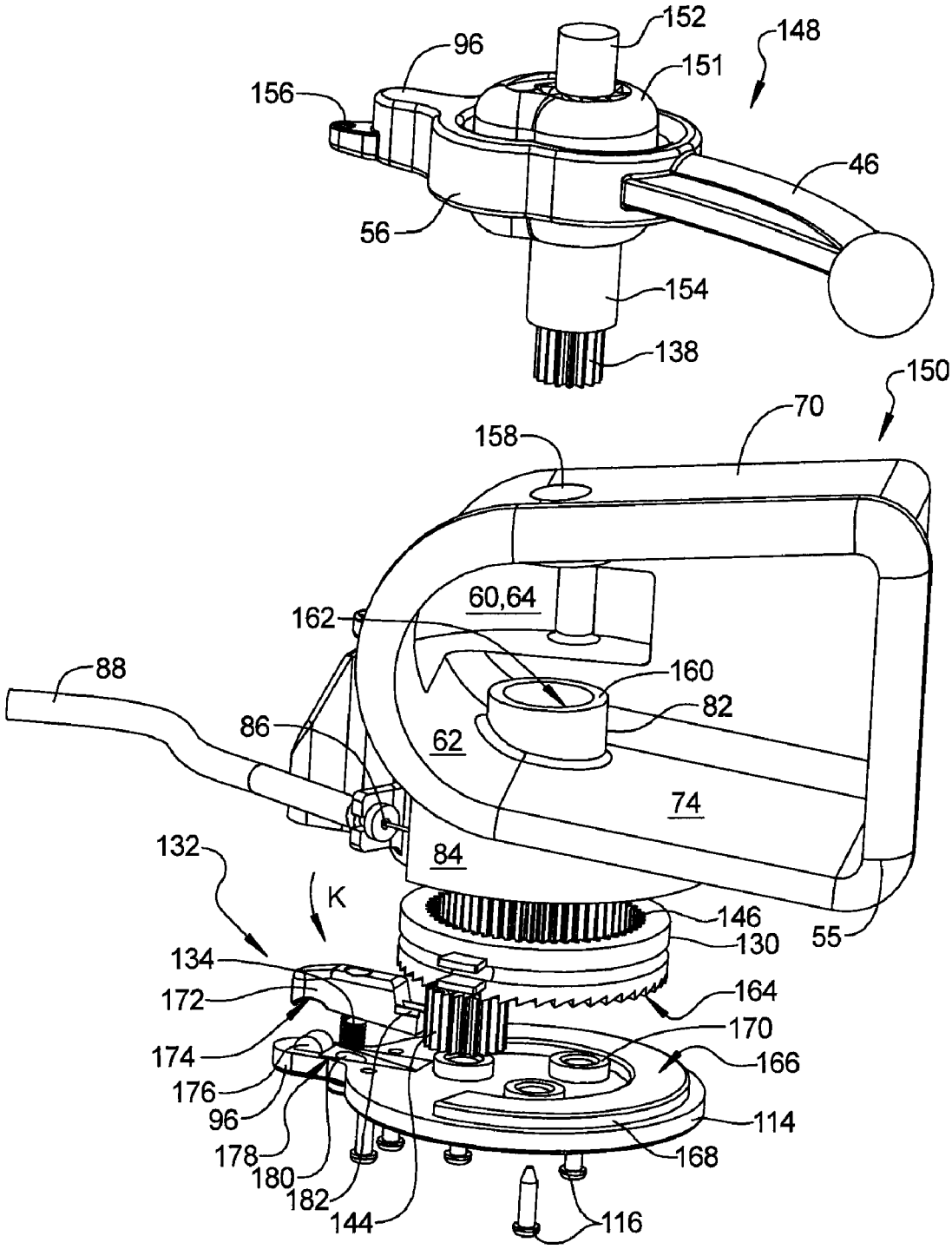
FIG. 7 is an assembly drawing of the force multiplier device of FIG. 2.

Referring to FIG. 7, details of a lever sub-assembly 148 and a housing/gear box sub-assembly 150 are as follows. Lever sub-assembly 148 includes lever arm 46, lever mount housing 56, and connecting arm 96, which define a homogenous molded member. A pivot base 151 which can also be provided of a molded polymeric material is disposed within lever mount housing 56. A first bearing shaft 152 extends upwardly as viewed in FIG. 7 from pivot base 151. A second bearing shaft 154 and sun gear 138 extend downwardly as viewed in FIG. 7 with respect to pivot base 151. An engagement aperture 156 is provided at a distal end of the connecting arm 96 to receive an engagement end of first biasing member 94 described in reference to FIG. 6.

Housing/gear box sub-assembly 150 includes the components of housing 55, gear housing 84, wire member 86 and flexible sheath 88. A bearing bore 158 is provided in housing upper wall 70 to rotatably receive first bearing shaft 152 of lever sub-assembly 148. As previously noted, connecting arm 96 extends through each of first and second aperture portions 60, 64 of housing 55 so that lever sub-assembly 148 is rotatable with respect to housing 55. A second bearing shaft 154 is received in a bearing wall 160 defining a bearing surface 162 of bearing sleeve 82. Gear ring 130 also provides a plurality of ratchet teeth 164 which slidably rotate with respect to a flat surface 166 of a semi-circular raised ring 168 created in gear housing cover 114. Each of the first, second and third planetary gears 140, 142, 144 (only third planetary gear 144 is shown in this view) are rotatably received by gear housing cover 114 using a planet gear carrier 170 created for each of the first, second and third planetary gears 140, 142, 144. Individual ones of the plurality of fasteners 116 can also be used to rotatably mount the first, second and third planetary gears 140, 142, 144 on each of the planet gear carriers 170.

Ratchet tooth assembly 132 includes a ratchet arm 172 which pivots at a rib receiving surface 174 which is partially rotatable about a raised rib 176 extending from a contact surface 178 of gear housing cover 114. Second biasing member 134 is received within a biasing member receiving bore 180 and also contacts a lower surface of ratchet arm 172 so that a plurality of ratchet engagement teeth 182 can ratchet upwardly and downwardly as viewed in reference to FIG. 7 with respect to the plurality of ratchet teeth 164 of gear ring 130. Gear ring 130 is therefore allowed to rotate in a gear ring direction of rotation "K" as lever arm 46 is rotated in the ratcheting direction "E" previously discussed. Gear ring 130 is prevented from rotation in an opposite direction to gear ring direction of rotation "K" by engagement of the plurality of ratchet engagement teeth 182 with the plurality of ratchet teeth 164.

To allow gear ring 130 to rotate in a clockwise direction (opposite to gear ring direction of rotation "K", ratchet arm 172 is displaceable downwardly as viewed in FIG. 7 when release switch 98 described in reference to FIG. 4 is downwardly displaced by motion of lever arm 46 in the release direction "G". Displacement of release switch 98 releases ratchet engagement teeth 182 from engagement with ratchet teeth 164, allowing rotation of gear ring 130 in a clockwise direction opposite to gear ring direction of rotation "K". The normal or biased engaged condition of ratchet arm 172 is therefore with ratchet engagement teeth 182 in engagement with the ratchet teeth 164 of gear ring 130 due to the biasing force created by second biasing member 134. Tooth engagement between each of the first, second and third planetary gears 140, 142, 144 is retained at all times with the internal gear 146 of gear ring 130 during motion in the gear ring direction of rotation "K" and also when lever arm 46 is released and rotation of gear ring 130 occurs in the clockwise direction opposite to gear ring direction of rotation "K".

Figure 8:
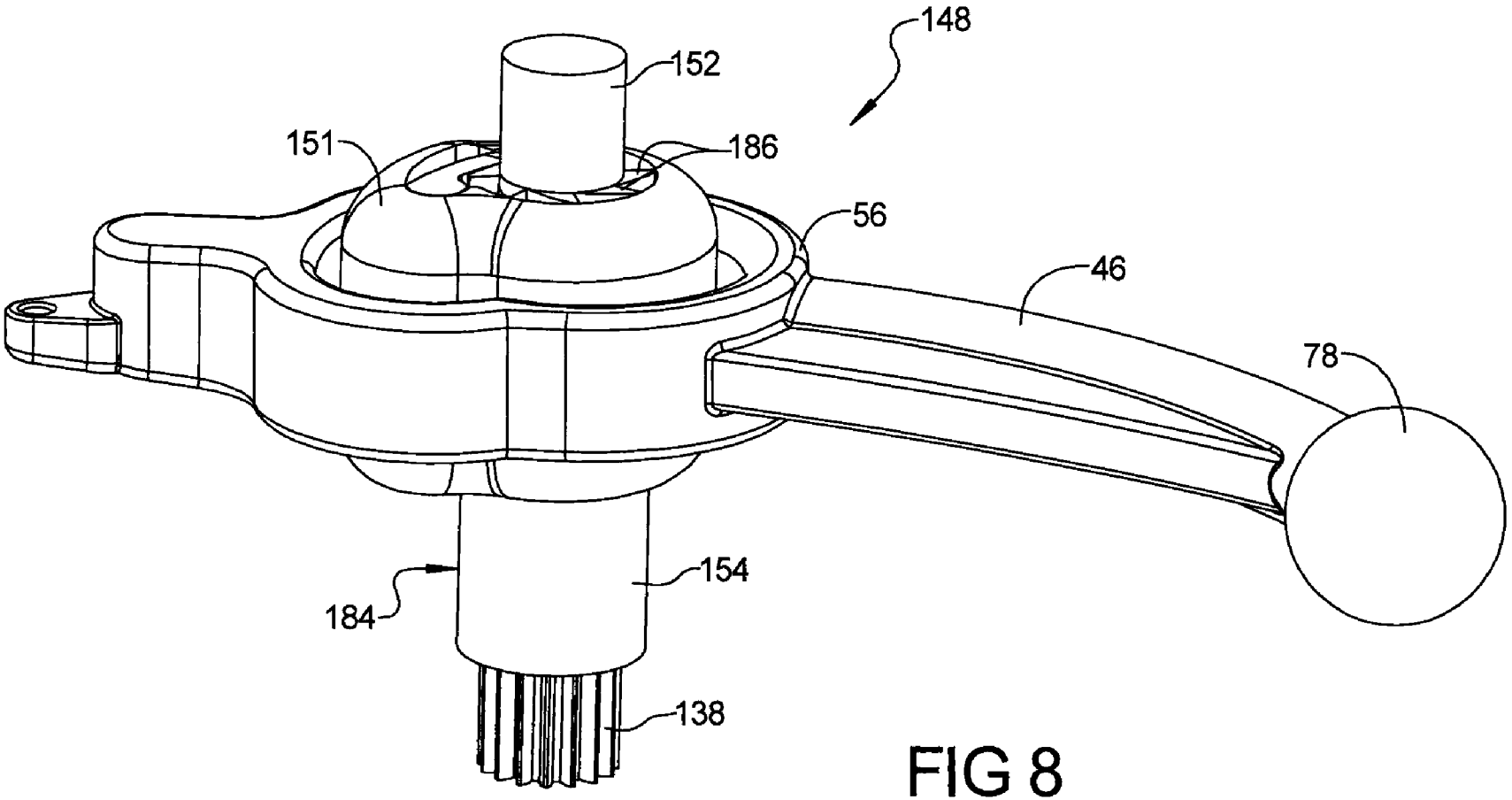
FIG. 8 is a front perspective view of a lever sub-assembly of the force multiplier device of FIG. 2.

Referring to FIG. 8, further details of lever sub-assembly 148 include a shaft assembly 184 which is created in part from each of the first bearing shaft 152, second bearing shaft 154, and sun gear 138. Shaft assembly 184 further includes a plurality of arced teeth 186 which are rotatably received within pivot base 151.

Figure 9:
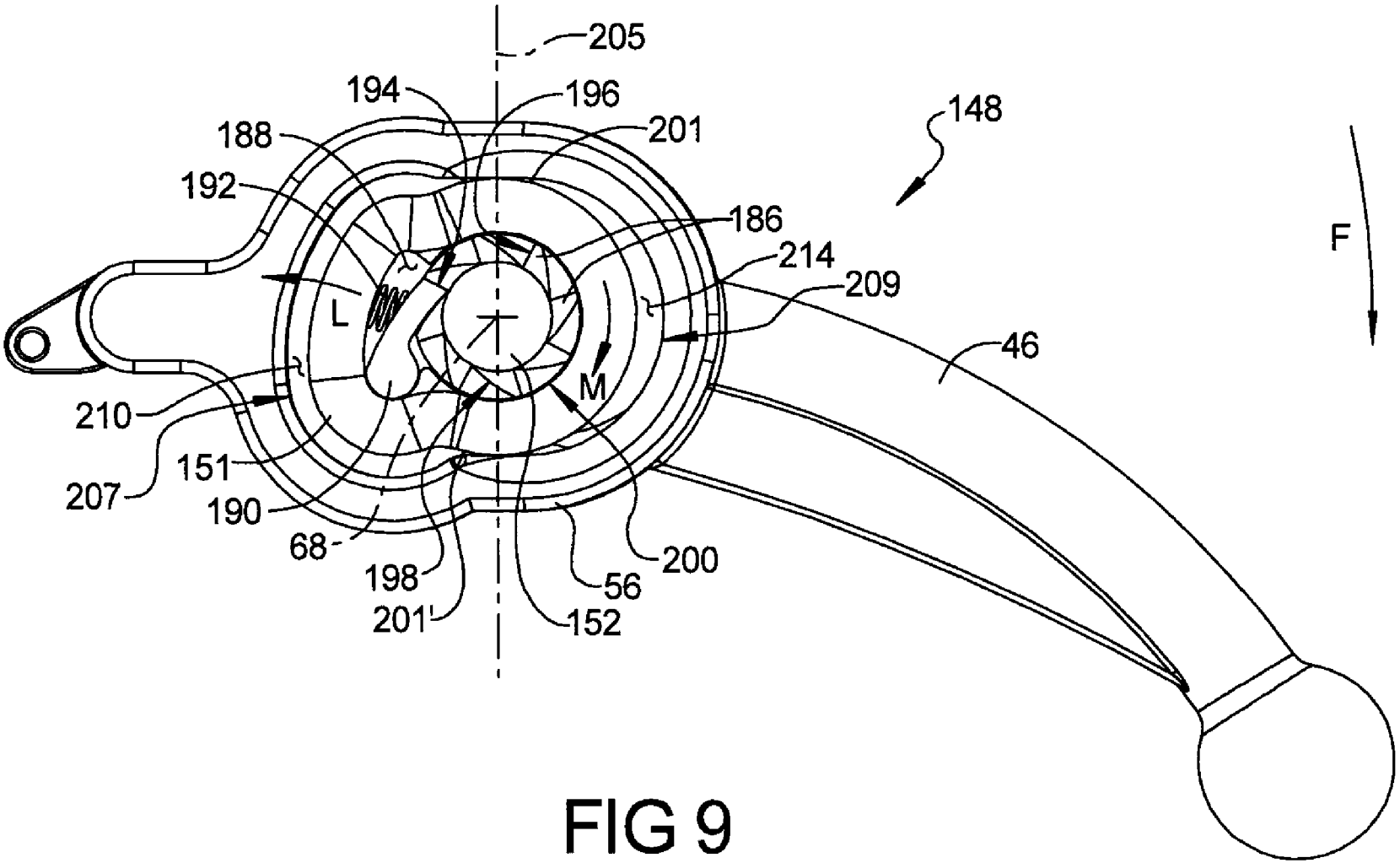
FIG. 9 is a top plan view of the lever sub-assembly of FIG. 8.
Figure 10:
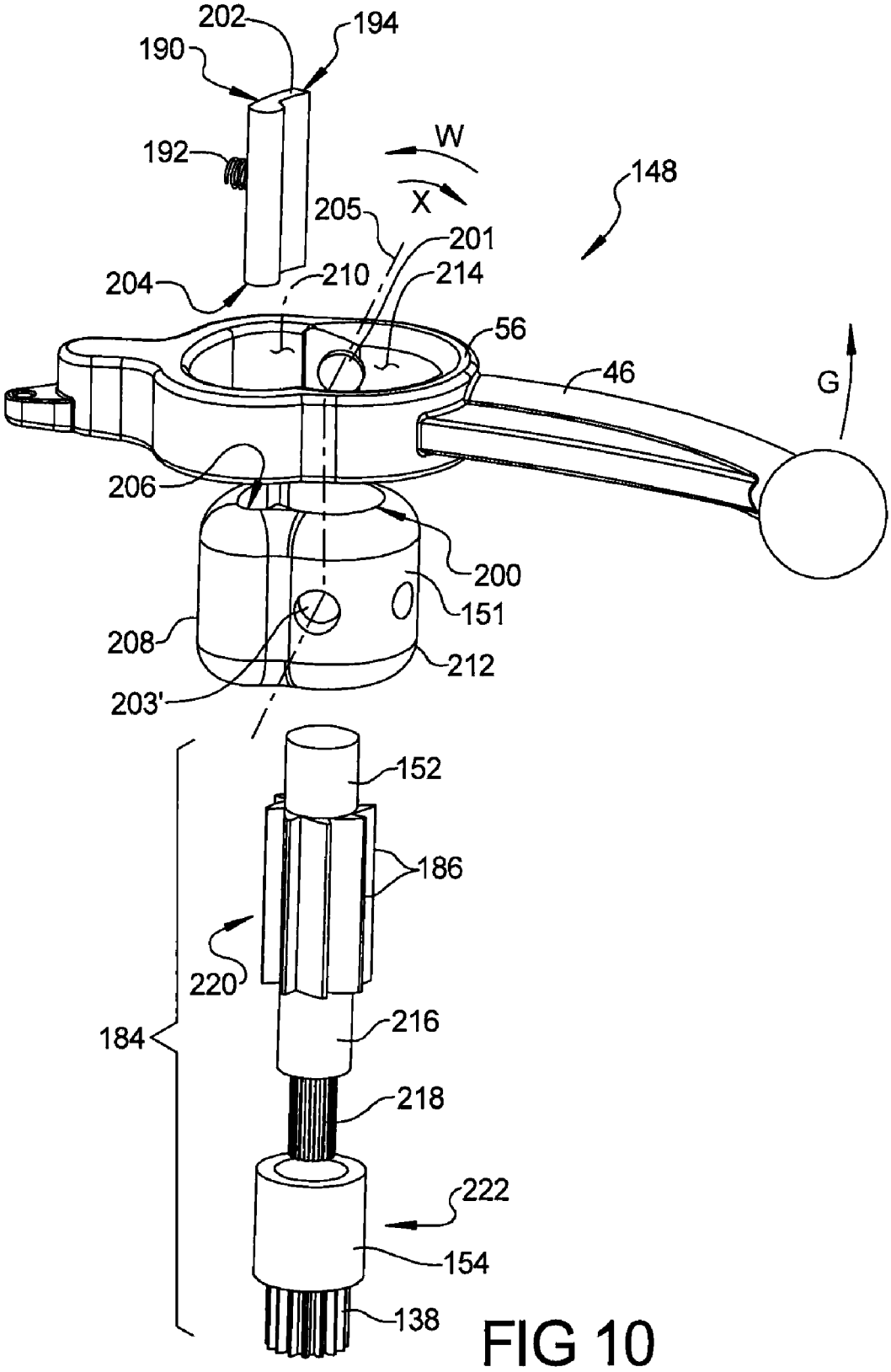
FIG. 10 is a front perspective assembly view of the lever sub-assembly of FIG. 8.

Referring to FIGS. 9 and 10, the cavity 188 of pivot base 151 is adapted to receive a pivot member 190, which is biased to the position shown using a pivot member biasing device 192 such as a coiled tension spring also positioned within cavity 188. An engagement face 194 of pivot member 190 is biased into engagement using pivot member biasing device 192 with a contact surface 196 of any one of the arced teeth 186. Lever arm 46 can therefore rotate in an arc of rotation "M" with respect to arced teeth 186 during travel in the free return direction "F". A sliding or ratcheting contact of pivot member 190 occurs with a plurality of arc shaped back faces 198 of the arced teeth 186, as pivot member 190 rotates counterclockwise as viewed in FIG. 9. Pivot member 190 rotates against the biasing force of pivot member biasing device 192 in a displacement direction "L" when contacted by the back faces 198 of arced teeth 186. As each of the arced teeth 186 pass pivot member 190, pivot member 190 is biased to engage the contact surfaces 196 at engagement face 194 to prevent rotation in a direction opposite to rotation direction "M". Arced teeth 186 are rotatably disposed with respect to a gear receiving bore 200 of pivot base 151.

Opposed first and second pins 201, 201' are homogenously connected to the lever mount housing 56. Pivot member 190 includes a pivot member arm 202 having engagement face 194 created at a free end thereof. Pivot member 190 also includes a semi-circular pivot body portion 204 which is rotatably received within a pivot body receiving surface 206 of pivot base 151. Pivot base 151 further includes each of a first pivot base portion 208 which is disposed within a first pivot base receiving bore 210 of lever mount housing 56, and a second pivot base portion 212 which is received within a second pivot base receiving bore 214 of lever mount housing 56. Clearance is provided between first and second pivot base receiving bores 210, 214 of lever mount housing 56 and the surfaces of both first and second pivot base portions 208, 212 of pivot base 151 to allow lever arm 46 and lever mount housing 56 to rock or tilt with respect to pivot base 151 in the release direction "G" defined in reference to FIG. 1.

The first and second pins 201, 201' are oriented facing each other within second pivot base receiving bore 214 of the lever mount housing 56. Opposed apertures 203, 203' (only aperture 203' is visible in FIG. 10) are created in the pivot base 151, each adapted to rotatably receive one of the first and second pins 201, 201'. The lever arm 46 and the lever mount housing 56 are rotatable about an axis of rotation 205 defined by the first and second pins 201, 201' when the lever arm 46 is rotated in the third or release direction "G". Clearance between a wall 207 of lever mount housing 56 and pivot base 151 is provided by first pivot base receiving bore 210, and clearance between a wall 209 of lever mount housing 56 and pivot base 151 is provided by second pivot base receiving bore 214 to allow pivot base 151 to rock or rotate with respect to axis of rotation 205. Referring again also to FIG. 4, axis of rotation 205 is oriented substantially transverse to the lever arm assembly axis of rotation 68 and rotation of lever arm 46 about axis of rotation 205 allows displacement of the wire member 86 in a second displacement direction "Z" opposite to the first displacement direction "Y".

As further shown in FIG. 10 and with further reference to FIG. 2, shaft assembly 184 is a two part assembly which includes first bearing shaft 152, arced teeth 186, an alignment shaft 216 and a shaft assembly spline gear 218 all forming part of a first shaft portion 220. A second shaft portion 222 of shaft assembly 184 includes second bearing shaft 154 connected to sun gear 138. The shaft assembly 184 when partially received in the bearing sleeve 82 defines the lever arm assembly axis of rotation 68.

Figure 11:
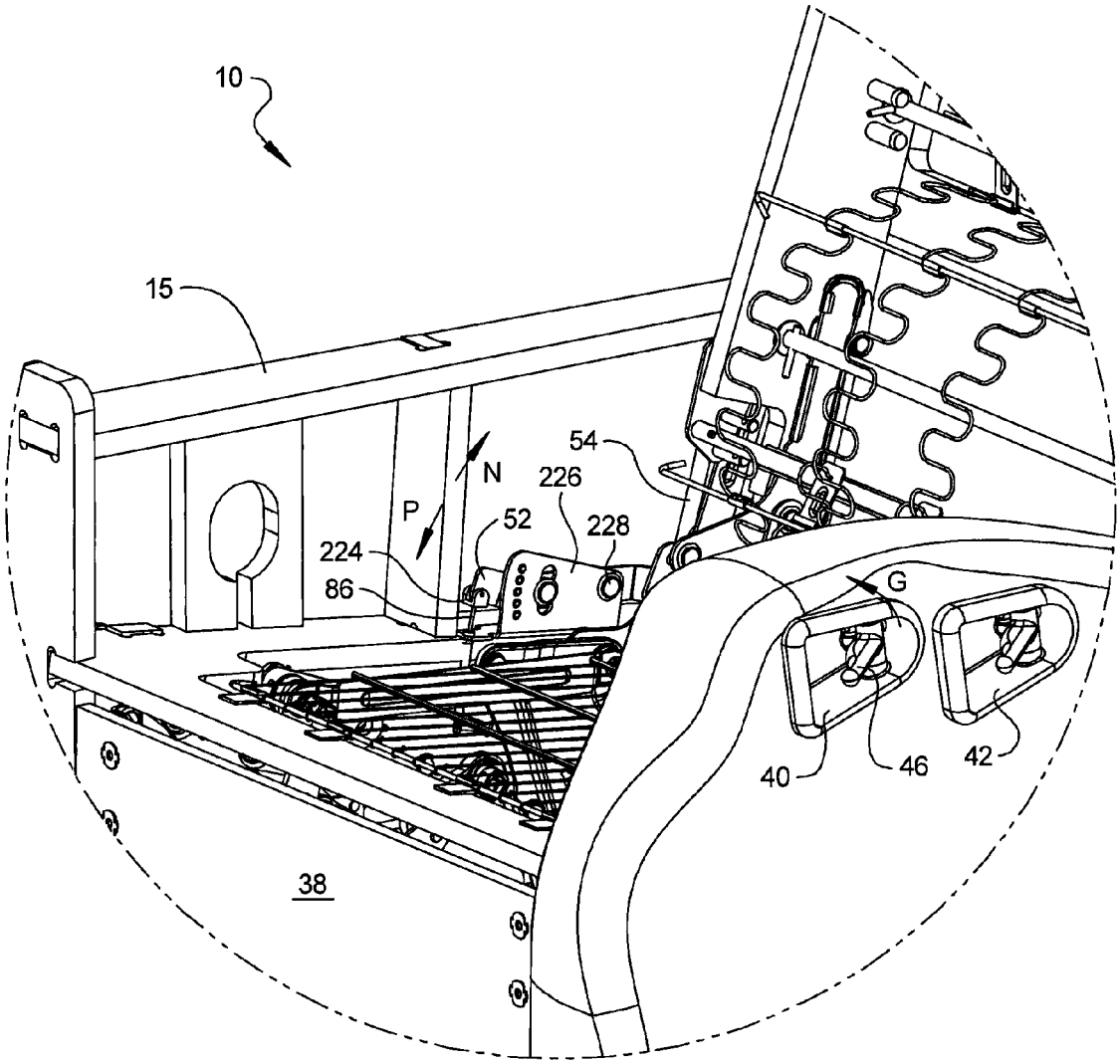
FIG. 11 is a partial front left perspective view of the furniture member of FIG. 1.

Referring to FIG. 11, one exemplary use for the drive mechanisms of the present disclosure is provided by first drive mechanism 40. First drive mechanism 40 is connected by wire member 86 to lever member 52 using a rotatable coupling 224. Displacement of wire member 86 by rotation of lever arm 46 causes subsequent rotation of lever member 52 which is rotatably coupled to a bracket 226 using a lever rotation pin 228. An opposite end of lever member 52 from the connection with rotatable coupling 224 is rotatably coupled to actuation link 54. Rotation of lever arm 46 incrementally axially displaces wire member 86 and therefore incrementally displaces lever member 52. Rotation of lever arm 46 rotates lever member 52 in a first lever member rotation direction "N", and by displacement of lever arm 46 in the release direction "G" lever member 52 can be rotated in a second lever member rotation direction "P".

Drive mechanisms of the present disclosure can be used for multiple purposes to control movable members of a furniture member 10. These include the previously described use of the drive mechanisms for control of a lumbar support system, and for control of a head rest assembly such as head rest assembly 22. Drive mechanisms of the present disclosure can also be used for other systems such as incremental rotation of leg rest assembly 38, or incremental rotation if desired of back support member 16. The force multiplying effect produced by drive mechanisms of the present disclosure provides additional benefits. In addition to incrementally moving the component of the furniture member, the drive mechanism also provides a ratcheting engagement to prevent return of the component until the lever arm is repositioned in the release direction "G". It should be evident that by controlling the geometry of the various gears of the drive mechanisms that the amount of incremental displacement of the components of the furniture member can be increased or decreased as desired. Drive mechanisms of the present disclosure can also be positioned in alternate locations from those shown and described herein. These can include positioning the drive mechanism on the seat pan 36 or on an occupant facing side of either one of the first or second arm rest support members 14, 15. Drive mechanisms of the present disclosure can also be used in tandem if desired to provide opposite motions of the components of the furniture member. For example, a first drive mechanism can provide a first rotation of a head rest assembly and a second drive mechanism can provide a second opposite direction of rotation of the head rest assembly.

Drive mechanisms of the present disclosure are described herein for use with furniture members which can be more broadly defined to include "seat members" including but not limited to automobile, aircraft, watercraft, train or rail, and commercial seats or chairs such as for office use.

What is claimed is:

1. A seat member component drive mechanism, comprising:

a force multiplying gear assembly including a sun gear and a plurality of planetary gears;

a wire member slidably disposed within a flexible sheath, the wire member connected to the gear assembly for axial displacement in a first and an opposite second displacement direction within the flexible sheath and to a component movably connected to a seat member for displacement of the component;

a lever arm rotatably connected to the gear assembly defining a lever arm first axis of rotation, rotation of the lever arm in a first direction about the first axis of rotation operating to axially displace the wire member in the first displacement direction; and a pivot base having the lever arm rotatably connected to the pivot base defining a second axis of rotation of the lever arm transverse to the first axis of rotation, the lever arm rotated about the second axis of rotation to displace the wire member in the second displacement direction.

2. The seat member component drive mechanism of claim 1, further including a shaft assembly wherein the lever arm is connected to the sun gear by the shaft assembly.

3. The seat member component drive mechanism of claim 1, wherein the gear assembly further includes a gear ring having an internal gear meshed with the plurality of planetary gears and a plurality of ratchet teeth.

4. The seat member component drive mechanism of claim 3, further including a ratchet arm having a plurality of ratchet engagement teeth, the ratchet arm biased to engage the ratchet engagement teeth with the ratchet teeth to allow rotation of the internal gear only about a first arc of rotation.

5. The seat member component drive mechanism of claim 4, further including a depressible switch depressed by the lever arm when the lever arm is rotated about the second axis of rotation to rotate the ratchet arm such that the ratchet engagement teeth disengage from the ratchet teeth.

6. The seat member component drive mechanism of claim 1, wherein a ratio of an output force of the gear assembly acting on the wire member compared to an input force acting on the lever arm has a range of approximately (2.5 to 4.0) to 1.

7. The seat member component drive mechanism of claim 6, wherein the drive mechanism is operably provided in a space envelope having a height of approximately 10.16 cm, a width of approximately 13.97 cm, and a depth of approximately 10.16 cm.

8. The seat member component drive mechanism of claim 1, wherein the gear assembly includes a gear ring meshed with the plurality of planetary gears and a slide member slidably disposed for radial displacement about a perimeter of the gear ring, the slide member connected to the wire member, wherein a ratio of a radial displacement of the lever arm compared to a radial displacement of the slide member defining an axial output displacement of the wire member has a range of approximately (2.5 to 4.0) to 1.

9. The seat member component drive mechanism of claim 8, wherein the drive mechanism is operably provided in a space envelope having a height of approximately 10.16 cm, a width of approximately 13.97 cm, and a depth of approximately 10.16 cm.

10. A furniture member component drive mechanism, comprising:

a housing;

a wire member slidably disposed within a flexible sheath, the flexible sheath fixedly connected to the housing;

a gear assembly disposed in the housing, the wire member connected to the gear assembly for axial displacement in a first displacement direction;

a lever arm assembly rotatably connected to the housing defining a lever arm assembly axis of rotation, the lever arm assembly connected to the gear assembly such that rotation of the lever arm assembly in a first direction about the lever arm assembly axis of rotation axially displaces the wire member in the first displacement direction, the lever arm assembly including a pivot member having an engagement face; and a shaft assembly having a sun gear meshed with the gear assembly and a plurality of arced teeth, individual ones of the arced teeth contacted by the engagement face as the lever arm assembly rotates in the first direction, the arced teeth individually having arc shaped back faces contacted by the pivot member permitting free rotation of the lever arm assembly in a second direction opposite to the first direction.

11. The furniture member component drive mechanism of claim 10, wherein the lever arm assembly includes:

a pivot base; and a lever arm rotatably connected to the pivot base defining a lever arm/pivot base axis of rotation, the lever arm and the pivot base together rotatable in the first direction about the lever arm assembly axis of rotation to operate the gear assembly.

12. The furniture member component drive mechanism of claim 11, further including a biasing element connected to both the housing and the lever arm, the biasing element elastically extending when the lever arm and the pivot base are rotated in the first direction to create a bias force operable when the lever arm is released to return the lever arm and the pivot base in the second direction opposite to the first direction.

13. The furniture member component drive mechanism of claim 12, wherein the lever arm assembly is rotatable about the lever arm/pivot base axis of rotation in a third direction substantially transverse to the first and second directions to release the wire member to return within the flexible sheath in a second axial displacement direction.

14. The furniture member component drive mechanism of claim 11, further comprising:

a bearing sleeve connected to the housing; and the shaft assembly extending through the pivot base, the shaft assembly partially received in the bearing sleeve such that the shaft assembly in the bearing sleeve defines the lever arm assembly axis of rotation.

15. The furniture member component drive mechanism of claim 14, wherein the gear assembly includes:

first, second, and third planetary gears disposed in meshed relationship with the sun gear.

16. The furniture member component drive mechanism of claim 15, wherein the gear assembly includes:

an internal gear ring having an internal gear in meshed relationship with each of the first, second, and third planetary gears; and a slide member disposed within a semi-circular cavity between the internal gear ring and an outer wall of the housing, the wire member connected to the slide member such that the slide member incrementally moves within the semi-circular cavity when the lever arm assembly is moved in the first direction.

17. The furniture member component drive mechanism of claim 15, wherein multiple repeat rotations of the lever arm assembly in the first direction are required to displace the slide member through a length of the semi-circular cavity.

18. The furniture member component drive mechanism of claim 15, wherein the gear assembly further includes:

an internal gear having ratchet teeth; and a ratchet arm having ratchet engagement teeth, the ratchet arm biased to engage the ratchet engagement teeth with the ratchet teeth of the internal gear to allow motion of the internal gear in a first rotational direction and prevent rotation in an opposite second rotational direction.

19. A furniture member component drive mechanism, comprising:

a housing;

a wire member slidably disposed within a flexible sheath, the flexible sheath fixedly connected to the housing;

a gear assembly disposed in the housing, the wire member connected to the gear assembly for axial displacement in a first displacement direction;

a lever arm assembly rotatably connected to the housing defining a lever arm assembly axis of rotation, the lever arm assembly connected to the gear assembly such that rotation of the lever arm assembly in a first direction about the lever arm assembly axis of rotation axially displaces the wire member in the first displacement direction;

a pivot base;

a lever arm rotatably connected to the pivot base defining a lever arm/pivot base axis of rotation, the lever arm and the pivot base together rotatable in the first direction about the lever arm assembly axis of rotation to operate the gear assembly;

a bearing sleeve connected to the housing;

a shaft assembly extending through the pivot base, the shaft assembly partially received in the bearing sleeve to define the lever arm assembly axis of rotation; and a biased release switch partially extending from the housing, the release switch depressed when the lever arm contacts a portion of the housing when rotated in a direction transverse to the first direction, depression of the release switch operating to allow the wire member to axially move in a second displacement direction.

20. A furniture member component drive mechanism, comprising:

a housing;

a wire member slidably disposed within a flexible sheath, the flexible sheath fixedly connected to the housing;

a gear assembly disposed in the housing, the wire member connected to the gear assembly for axial displacement in a first displacement direction;

a lever arm assembly rotatably connected to the housing defining a lever arm assembly axis of rotation, the lever arm assembly connected to the gear assembly such that rotation of the lever arm assembly in a first direction about the lever arm assembly axis of rotation axially displaces the wire member in the first displacement direction;

a pivot base;

a lever arm rotatably connected to the pivot base defining a lever arm/pivot base axis of rotation, the lever arm and the pivot base together rotatable in the first direction about the lever arm assembly axis of rotation to operate the gear assembly;

a lever mount housing homogenously connected to the lever arm;

opposed first and second pins homogenously connected to the lever mount housing, the first and second pins oriented facing each other within a cavity of the lever mount housing; and opposed apertures created in the pivot base each adapted to rotatably receive one of the first and second pins, the lever arm and the lever mount housing being rotatable about an axis of rotation defined by the first and second pins substantially transverse to the lever arm assembly axis of rotation to displace the wire member in a second displacement direction opposite to the first displacement direction.

21. A furniture member component drive mechanism, comprising:

a housing;

a wire member slidably disposed within a flexible sheath, the flexible sheath fixedly connected to the housing;

a lever arm assembly rotatably connected to the housing defining a lever arm assembly axis of rotation;

a gear assembly disposed in the housing, the wire member connected to the gear assembly, the gear assembly including:

a sun gear connected to the lever arm assembly;

a plurality of planetary gears in meshed relationship with the sun gear; and a gear ring having an internal gear in meshed relationship with the plurality of planetary gears;

wherein rotation of the lever arm assembly in a first direction about the lever arm assembly axis of rotation is operable to incrementally axially displace the wire member in a first displacement direction.

22. The furniture member component drive mechanism of claim 21, wherein the lever arm assembly includes:

a pivot base; and a lever arm rotatably connected to the pivot base defining a lever arm/pivot base axis of rotation, the lever arm and the pivot base together rotatable in the first direction about the lever arm assembly axis of rotation to operate the gear assembly.

23. The furniture member component drive mechanism of claim 22, further comprising:

a bearing sleeve connected to the housing; and a shaft assembly extending through the pivot base, the shaft assembly partially received in the bearing sleeve such that shaft assembly in the bearing sleeve defines the lever arm assembly axis of rotation.

24. The furniture member component drive mechanism of claim 23, wherein the shaft assembly further comprises a plurality of arced teeth, individual ones of the arced teeth having a contact surface and an arc shaped back face.

25. The furniture member component drive mechanism of claim 24, further comprising a pivot member rotatably disposed in an aperture of the pivot base, the pivot member including an engagement face, the pivot member biased toward the plurality of arced teeth such that the engagement face contacts the contact surface of each individual one of the arced teeth as the shaft assembly rotates with respect to the pivot base.

26. The furniture member component drive mechanism of claim 21, wherein the sun gear is connected to the shaft assembly.

27. A furniture member component drive mechanism, comprising:

a housing having a bearing sleeve;

a lever arm assembly, including:

a pivot base having opposed pivot pins oriented facing each other;

a lever arm rotatably connected to the pivot pins of the pivot base defining a lever arm/pivot base axis of rotation; and a shaft assembly extending through the pivot base, the shaft assembly partially received in the bearing sleeve such that the lever arm and the pivot base are together rotatable in a first direction and an opposed second direction about a lever arm axis of rotation defined by a longitudinal axis of the shaft assembly; and a biasing element connected to both the housing and the lever arm elastically extending when the lever arm and the pivot base are rotated in the first direction to create a bias force operable when the lever arm is released to return the lever arm and the pivot base in a second direction opposite to the first direction, the lever arm being rotatable about the lever arm/pivot base axis of rotation in a third direction substantially transverse to the first and second directions.

28. The furniture member component drive mechanism of claim 27, wherein the housing is a polymeric material, the housing further including a homogenously connected bearing sleeve adapted to rotatably receive a bearing shaft of the shaft assembly.

29. The furniture member component drive mechanism of claim 27, wherein the lever arm further includes a lever contact arm extendable through an aperture created in the housing, the aperture allowing rotation of the lever arm in each of the first, second, and third directions.

30. The furniture member component drive mechanism of claim 27, wherein the shaft assembly further includes a bearing shaft axially extending into a bearing bore created in the housing.

31. The furniture member component drive mechanism of claim 27, further including a gear assembly having a sun gear and a plurality of planetary gears meshed with the sun gear, the shaft assembly engaged with the sun gear to rotate the gear assembly when the lever arm is rotated in the first direction.

32. A furniture member, comprising:

a base member;

an occupant support component movable with respect to the base member;

a drive mechanism mounted to the base member and operable to control displacement of the component with respect to the base member, including:

a housing; and a lever arm assembly rotatably connected to the housing defining a lever arm assembly axis of rotation, the lever arm assembly rotatable in each of a first and opposite second directions about the lever arm assembly axis of rotation;

a wire member connected to the drive mechanism and the component operable to displace the component upon actuation of the drive mechanism;

a pivot base; and a lever arm rotatably connected to the pivot base defining a lever arm/pivot base axis of rotation, the lever arm and the pivot base together rotatable in the first direction about the lever arm assembly axis of rotation to incrementally displace the component from a first to a second position;

wherein the lever arm is displaceable in a third direction substantially transverse to the first and second directions to displace the movable component from the second to the first position.

33. A furniture member, comprising:

a base member;

an occupant support component movable with respect to the base member;

a drive mechanism mounted to the base member and operable to control displacement of the component with respect to the base member, including:

a housing;

a lever arm assembly rotatably connected to the housing defining a lever arm assembly axis of rotation, the lever arm assembly rotatable in each of a first and opposite second directions about the lever arm assembly axis of rotation;

a wire member connected to the drive mechanism and the component operable to displace the component upon actuation of the drive mechanism;

a pivot base; and a lever arm rotatably connected to the pivot base defining a lever arm/pivot base axis of rotation, the lever arm and the pivot base together rotatable in the first direction about the lever arm assembly axis of rotation to incrementally displace the component from a first to a second position;

wherein the lever arm assembly includes a biasing element connected to both the housing and the lever arm extendable when the lever arm and the pivot base are rotated in the first direction to create a bias force operable when the lever arm is released to return the lever arm and the pivot base in the second direction.

34. The furniture member of claim 32, wherein the housing includes a face plate homogenously connected to the housing, the face plate adapted to extend partially over an upholstery layer of the furniture member.

35. The furniture member of claim 32, wherein the base member includes a seat pan, the drive mechanism being oriented at a declination angle with respect to the seat pan.

36. The furniture member of claim 32, wherein the furniture member includes a back support member rotatable with respect to the base member within a range of positions including a fully upright position and a fully reclined position inclusive.

37. The furniture member of claim 36, wherein the base member includes a arm rest support member, the drive mechanism being mounted to an outward facing side of the arm rest support member such that an occupant of the furniture member can reach the drive mechanism with the back support member positioned in any of the range of positions.

* * * * *